US006875471B2

(12) United States Patent
Lee et al.

(10) Patent No.: US 6,875,471 B2
(45) **Date of Patent: *Apr. 5, 2005**

(54) METALLIZATION OF POLYMER PARTS FOR PAINTING

(75) Inventors: Hsai-Yin Lee, Troy, MI (US); Yar-Ming Wang, Troy, MI (US); Tao Xie, Troy, MI (US)

(73) Assignee: General Motors Corporation, Detroit, MI (US)

( * ) Notice: Subject to any disclaimer, the term of this patent is extended or adjusted under 35 U.S.C. 154(b) by 65 days.

This patent is subject to a terminal disclaimer.

(21) Appl. No.: 10/304,086

(22) Filed: Nov. 25, 2002

(65) Prior Publication Data

US 2004/0050703 A1 Mar. 18, 2004

Related U.S. Application Data

(63) Continuation-in-part of application No. 10/135,181, filed on Apr. 30, 2002.

(51) Int. Cl.[7] ..... C25D 15/00; C25D 5/56; C23C 28/00; B05D 1/36

(52) U.S. Cl. ..... 427/404; 204/484; 204/486; 204/487; 204/488; 205/164; 205/166; 205/167; 205/168; 205/169; 205/196

(58) Field of Search ..... 204/484, 486, 204/487, 488; 205/164, 166, 167, 168, 169, 196; 427/404

(56) References Cited

U.S. PATENT DOCUMENTS

| | | | | |
|---|---|---|---|---|
| 3,955,017 A | | 5/1976 | Colebourne et al. | 427/383 |
| 4,039,714 A | * | 8/1977 | Roubal et al. | 428/336 |
| 2003/0201186 A1 | * | 10/2003 | Lee et al. | 205/164 |

* cited by examiner

*Primary Examiner*—Edna Wong
(74) *Attorney, Agent, or Firm*—Kathryn A. Marra

(57) ABSTRACT

The quality of painted surfaces of polymeric articles is improved by depositing a coating of a metal such as zinc or zinc alloy on the surface of the article to be painted. For example, zinc is electrodeposited on a conductive surface of the article. The metal coated polymeric surface provides a good base for electrostatic deposition of either liquid or powder paint and the metal surface prevents the formation of defects in the painted surface during heating of the article to dry or cure the paint film.

16 Claims, No Drawings

METALLIZATION OF POLYMER PARTS FOR PAINTING

This application is a continuation-in-part of co-pending application U.S. Ser. No. 10/135,181 filed Apr. 30, 2002, now pending.

TECHNICAL FIELD

This invention pertains to a method of preparing polymer or polymer composite parts for painting. For example, it is applicable to all the major polymeric substrates considered for automotive body parts. More specifically this invention pertains to the application of a zinc metal based coating, or other suitable metal based coating, to all surfaces of such parts to virtually eliminate the occurrence of surface and edge defects during subsequent painting and paint baking operations.

BACKGROUND OF THE INVENTION

The term "polymer composite" broadly refers to polymer based compositions that are formulated to contain additives to improve their properties for a specific application. The polymer composites may contain, for example, reinforcing fibers, fillers, pigments and other polymers. Polymer composite components are available for use in many commercial applications. They offer great potential as relatively low weight body panels and other components in automotive vehicles.

In the case of automotive vehicle body panel applications, polymer composites include, for example, compression molded sheet molding compound (SMC) containing unsaturated polyester and polystyrene resins, reinforced reaction injection molded (RRIM) polyureas, or injection molded products containing poly (phenylene oxide) (PPO)/nylon based resins. Such polymer composite parts are lighter than comparably sized steel panels. However, the composites do have to be painted for body panel applications, and it has been difficult to paint the composite body panels without introducing surface defects. Normally, the composite body panels are not suitably electrically conductive for electrolytic or electrostatic deposition of paints. Further, they tend to release solvent vapor or gases during high temperature paint baking operations that damage introduce defects in the paint layers.

Automotive painting operations are typically carried out on a body-in-white. A body-in-white is the unpainted unitary body structure comprising welded, or otherwise attached, body panels and structural components. Such a body structure is usually formed mostly of steel panels but now may include some polymer composite panels. The paint shop practice is established for the steel portion of the body which is electrically conductive and receives several coating layers for corrosion resistance, paint adhesion and painted surface finish quality. The composite panels do not respond to the several coating procedures in the same way as the steel panels. For example, automotive painting operations often involve the separate application of a zinc phosphate layer, an electrocoated liquid (i.e., using water or an organic solvents) prime, a liquid or powder primer surfacer layer, a liquid base color coat and a liquid or powder clear top coat. But there is no deposition of either the zinc phosphate coating or the electrocoated prime on the typical polymer composite panel surfaces.

Following each of the prime coat, the primer surfacer and the clear top coat applications there is a baking step at temperatures of 250° F. or higher to cure or dry the new layer and to promote flow of the top coat films to a commercially acceptable finish for a vehicle. Such aggressive heating of the painted composites typically leads to "out-gassing." Out-gassing is the release of entrapped air, solvent, moisture, and uncured chemicals and polymer precursor materials from the somewhat porous composite substrate. The result too often is an unsightly and unacceptable rough surface. Out-gassing was initially experienced with liquid primer surfacer paints at their 250° F. bake temperature. The occurrence of surface roughness with such paint systems has been reduced in some instances by the use of a specially formulated, electrically conductive polymer prime coat as a barrier coat after molding. This polymeric prime coat on the composite surface may reduce out-gassing at that location. But this coating doesn't appear to work for all molded polymer composite and liquid paint combinations, and it completely fails to prevent out-gassing during the flow and curing of powder paints which require even higher bake temperatures (350° F.).

Accordingly, it is an object of the invention to provide a method of treating the surfaces of polymer composite and other polymeric articles of manufacture to avoid out-gassing caused defects during post-molding painting operations. Further, it is an object of this invention to provide a conductive metal coating on molded polymeric surfaces to permit, for example, the phosphating and subsequent prime coatings and top coatings of automotive body panels yielding uniformly appearing and high quality surface finishes.

SUMMARY OF THE INVENTION

This invention is applicable to the painting of surfaces of polymer composite parts and other molded polymer parts. It is a method that results in the formation of a metal or metal alloy coating on the composite surface prior to painting. The purpose of the metal coating is to prepare the surface of the polymeric part for phosphating or the like, if desired. The metal layer makes the surface of the part conductive for electrostatic painting with liquid (solvent or water based) or dry powder paints, and it provides an impermeable layer to prevent out-gassing from the polymer or polymer composite into the newly applied paint layers, especially during paint drying or curing steps.

Preferably, the metal is zinc or a suitable zinc based alloy, especially for applications on automotive body panels that are expected to be processed through an automotive paint shop. Zinc, of course, is used on galvanized steel body panels and paint shops have long been adapted to the phosphating and painting of zinc or zinc alloy coated, steel body panels. However, other metals such as iron and aluminum and their alloys are also suitable for use in the practice of this invention.

The method is applicable to any polymer or polymer composite part, especially parts that have been formulated for automotive body panel applications. In accordance with the practice of the invention, the surface of the part must be receptive to the deposition of the metal barrier layer. The deposition process must be inexpensive and fast especially for application in automotive manufacturing operations. When the metal coating is to be zinc or a zinc alloy, the familiar and preferred practice is to deposit the zinc material electrolytically. This means that the surface of the polymeric material must be sufficiently electrically conductive for such "galvanizing" of the polymeric material.

Some polymer composites, for example, may have sufficient surface conductivity for deposition of the metal layer because of conductive materials in their formulation such as carbon particles, graphite fibers or even conductive polymer moieties. Other non-conductive polymer parts may be surface treated by one of many known practices for imparting sufficient conductivity for electrolytic deposition of the zinc or other metal layer. Some of these surface treatments will be described in more detail below in this specification. However, for the purpose of a summary of the invention an example of a preferred practice for treating the surface of a polymer composite will be used.

The practice of this invention is not limited by any specific earlier preparation of the polymeric part, but a description of typical polymer composite molding steps, for example, is helpful in understanding the use of the invention. After a suitable mixture of polymer composite precursors is prepared, the mixture is molded and, if required, cured. In normal current practice, the polymeric mixture for an automotive body panel will not have been formulated to be electrically conductive. In these cases, surfaces of the composite part to be painted are prepared for the deposition of a first conductive layer to permit electrolytic deposition of the zinc layer. Thus, the composite part is typically dipped in an etching solution to roughen and oxidize the surface. After removal of excess etching agents, the surface is treated with a suitable colloidal metal catalyst, often palladium, to provide sites on the surface for an electroless coating of copper or nickel. The thin coating of copper or nickel is then applied. As stated, this electroless copper coating, or a like conductive coating, is the conductive base for the deposition of zinc or suitable zinc galvanizing alloy. Additional layers of metal can be applied on the copper/nickel layer for leveling of the thin layer, or for matching thermal expansion characteristics, or the like.

In accordance with the invention, a coating of zinc is then electroplated on the electroless conductive metal coating. In other words, in this example the composite part is "galvanized." The zinc coating better prepares the composite for, phosphating and/or electrostatic painting. But most importantly the zinc or zinc alloy coating prevents out-gassing during the high temperatures experienced by the part during paint drying and/or curing. A suitable metal coating such as a zinc coating is the only known way to prevent such out-gassing following powder coat painting and high temperature paint baking. Thus, an important advantage of the subject invention is that polymeric components, such as automotive body panels, can be formulated to provide physical properties for their intended use but easily adapted for painting and painted surface quality just like steel panels. The invention is particularly useful with polymer panels intended for painting with current powder paint formulations because of their requirement of high baking temperatures of order of 350 F.

Other objects and advantages of the invention will become more apparent from a detailed description of the invention which follows.

DESCRIPTION OF A PREFERRED EMBODIMENT

An illustrative example will be given of one method of forming a conductive surface on a molded polymer composite article for the subsequent electrodeposition of a zinc metal coating. The following example is a process for the deposition of a conductive copper layer that has been used to prepare molded polymer articles for electroplating with chromium. This process has been used for this purpose on many different polymeric substrates and therefore has demonstrated wide applicability. However, it is to be understood that other methods can be used to provide a conductive surface on the composite article for deposition of the zinc (or equivalent metal) containing layer that is a critical feature of this invention.

The molded composite part is dipped in an etching solution (e.g. a mixture of sulfuric and chromic acids) to roughen and oxidize the surface. Etching provides a roughened surface for mechanical interlocking with the copper layer to be deposited. The roughened surface also increases the area of contact between the substrate and the metal deposit thus increasing the available sites for chemical bonding between the two. The etching also makes the composite surface more hydrophilic for the following process steps. Following a suitable etching period, the part is removed from the etching solution and dipped in a neutralizing rinse to remove residuals that are detrimental for the following steps.

The etched composite surface is then treated with an aqueous colloidal suspension of a suitable mixture of tin and palladium chlorides to deposit catalytic nuclei particles of palladium at sites on the surface. The excess tin is then removed from the palladium-activated surface.

The activated composite surface is then contacted with a bath of suitable electroless copper plating composition. The catalyzed composite surface promotes the reduction of the copper compound(s) in the bath to deposit a copper coating film on the surface of the molded composite article. The thickness of the copper film is, for example, about one-half to one micrometer. An electroless nickel deposit may be made instead of the copper layer. Electroless nickel deposits may contain small amounts of phosphorus and/or boron. But the object of this metal deposition step is to make the composite surface uniformly conductive and receptive to the electroplating of a suitable zinc or zinc alloy coating.

The well known systems for the electroless deposition of copper or nickel yield a very thin coating of conductive metal on an etched surface with microscopic peaks and valleys. Sometimes it is preferred to add an additional metal layer for purposes of leveling the electroless conductive coating, or for modifying the coefficient of thermal expansion of the coating, or for later electrochemical machining or polishing of the part. One or more layers of any suitable metal may be applied by any suitable means for such a purpose. However, in this specific example no such intervening layer over the electroless conductive layer was deemed necessary.

Zinc electroplating of the conductive composite surface can now be accomplished. Zinc or a zinc alloy can be electroplated by any suitable commercial acid or alkaline zinc plating process. An example of a zinc alloy is one containing, for example, six to twelve or thirteen percent by weight nickel. A zinc coating, or other metal coating, thickness of about fifteen to twenty-five micrometers is preferred. The composite surface is now ready for phosphating and/or painting in accordance with the requirements of the final polymer composite product. However, the zinc coating makes the composite article particularly ready for painting operations of the type carried out in an automotive paint shop.

Following is an outline of a typical automotive painting process for a composite exterior body panel such as a door, fender, rocker panel or the like.

When the zinc coated composite panel reaches the paint shop as part of an automotive body-in-white (i.e., unpainted body), the vehicle body is cleaned and degreased to remove surface contaminants. The whole body, with its steel panels and composite panels, is immersed in a suitable phosphating bath to form an adherent integral layer of phosphate. As is well known in automotive technology, the phosphate layer provides paint adhesion to the body panels and limits corrosion of the panels due to stone chipping or other damage to the vehicle in use. The zinc layer on the composite panel functions like a "galvanized" zinc layer on a steel panel. And the zinc layer on the composite facilitates the formation of the phosphate layer on the composite panel.

After rinsing and drying, the phosphated vehicle body is immersed in an electrolytic bath of prime coat paint composition. This electrocoat primer is electrolytically dispersed over the entire immersed body. Again, the zinc layer on the composite panel portions of the body promotes the deposition of the corrosion resistant primer coating. The vehicle body is removed from the bath, drained, rinsed and then baked at 350° F. or so to cure the prime coat layer and produce a coherent film over the entire body. The zinc layer resists popping of the composite surface during this high temperature exposure of the composite panel.

A liquid or powder primer surfacer coating is then applied to the prime coated body. The liquid or powder primer surfacer paint is usually charged and the body electrically grounded for this purpose to better attract the sprayed coating. The conductive zinc coating on the composite panels assists in this coating operation. This primer surfacer coating is also baked on the vehicle body at a temperature of 250° F. or 350° F., depending on whether the primer surfacer is a liquid or powder based formulation. The zinc coating on the composite layer stops out-gassing at the painted surface.

Similarly a pigmented paint layer is usually also electrostatically applied to the vehicle body followed by a clear topcoat. These layers are also baked for film flow and curing. Still, the zinc coating on the composite panels prevents the formation of surface defects.

Accordingly, this invention provides a way of preparing polymer matrix composite articles for high temperature paint baking operations while avoiding the formation of unsightly defects in the surface of the painted composite body. The practice of forming a zinc based coating on the composite surface enables the wide spread use of composite panels in automotive applications where protective and decorative phosphate and/or paint layers are to be applied.

In the above example zinc or zinc alloy was used as the electrically conductive layer for zinc phosphating and painting of the polymeric body panels assembled in the body-in-white. The zinc containing layer also served as a barrier to out gassing of the polymer composite during paint baking operations to preserve the finish appearance of the painted surface. Other metals, such as aluminum or iron can be similarly deposited on a conductive surface of the polymeric part and used in the same capacity as the zinc material was used. For example, iron can be suitably electrodeposited on a conductive surface of the polymer panel in a thickness for their painting and baking support function. Aluminum can be deposited easily using vacuum techniques such as sputtering, electron beam evaporation or the like. The thickness of the metal layer is determined for the specific polymeric part application. In general it has been found that barrier thicknesses of zinc or zinc alloy in the range of about ten to twenty five micrometers are suitable on a typical polymer composite of the types described in this specification.

As described, automotive body panels have been molded of polymer composites for weight reduction and other advantages. Several polymer containing composite formulations have been developed that provide suitable mechanical and chemical properties for such applications. One requirement for the polymer containing compositions is that they be able to withstand the temperatures encountered by the vehicle body during one or more paint baking cycles in the paint shop. In general, polymer composites as broadly defined in this specification have best provided the necessary properties at a cost acceptable for automotive applications. However, it is to be understood that this invention is also applicable to high temperature resistant polymers that may not require additives to provide the properties generally required for automotive panel applications.

Thus the invention has been described in terms of an illustrative example. But other practices may be adapted to form useful metal coatings on polymeric surfaces and thereby realize the benefits of this invention. Accordingly, the scope of the invention is to be considered limited only by the following claims.

What is claimed is:

1. A method of painting a surface of a polymeric article with one or more paint layers when said article is subjected to baking of a paint layer, said method comprising:

forming a metal coating on said surface as a barrier coating to out-gassing from said polymeric article during said baking of a paint layer, depositing a layer of paint on said surface having said barrier coating and, thereafter baking said paint layer.

2. A method as recited in claim 1 in which said metal barrier coating comprises a metal selected from the group consisting of aluminum, iron, or zinc.

3. A method as recited in claim 1 in which said metal barrier coating is zinc or a zinc based alloy.

4. A method as recited in claim 1 comprising forming at least one layer of a conductive metal on said surface of said polymeric article and then forming said metal barrier coating by electrodeposition on said conductive metal layer.

5. A method as recited in claim 4 in which said metal barrier coating comprises iron or zinc, and said barrier coating has a thickness of about ten micrometers or more.

6. A method as recited in claim 4 in which said metal barrier coating is zinc or a zinc based alloy and said barrier coating has a thickness of about ten micrometers or more.

7. A method of painting an automobile body-in-white when said body comprises a molded polymeric body panel and said body is to be subjected to a paint baking operation following said painting, said method comprising:

assembling said body-in-white with said polymeric body panel, said body panel having a metal coating on a surface of said panel to be painted, said metal coating serving as a barrier coating to out-gassing from said panel during said paint baking operation;

applying at least one coating of paint to said body-in-white including said surface of said panel, and then subjecting said body including said panel to said baking operation.

8. A method as recited in claim 7 in which said metal barrier coating comprises a metal selected from the group consisting of aluminum, iron, or zinc.

9. A method as recited in claim 7 in which said metal barrier coating is zinc or a zinc based alloy.

10. A method as recited in claim 7 in which said metal barrier coating comprises a metal selected from the group consisting of aluminum, iron or zinc and said barrier coating has a thickness of about ten micrometers or more.

11. A method as recited in claim 7 in which said metal barrier coating is zinc or a zinc based alloy and said barrier coating has a thickness of about ten micrometers or more.

12. A method as recited in claim 7 in which at least one coating of paint is a coating of powder paint applied by electrostatic deposition.

13. A method as recited in claim 12 in which said baking operation is conducted at a temperature of 250 F or higher.

14. A method as recited in claim 7 in which said baking operation is a coating of powder paint applied by electrostatic deposition.

15. A method as recited in claim 14 in which said baking operation is conducted at a temperature of 250 F or higher.

16. A method of painting an automobile body-in-white when said body comprises a molded polymeric body panel and said body is to be subjected to a paint baking operation following said painting, said method comprising:

assembling said body-in-white with said polymeric body panel, said body panel having a metal coating on a surface of said panel to be painted, said metal coating serving as a barrier coating to out-gassing from said panel during said paint baking operation;

applying a zinc phosphate coating to said body-in-white including said surface of said panel;

applying at least one coating of paint by electrolytic deposition or electrostatic deposition to said body-in-white including said surface of said panel, and then subjecting said body including said panel to said baking operation at a temperature of 250 F or higher.

* * * * *